US011552404B2

(12) United States Patent
Chung et al.

(10) Patent No.: US 11,552,404 B2
(45) **Date of Patent: *Jan. 10, 2023**

(54) MULTIBENDING ANTENNA STRUCTURE

(71) Applicant: CUBTEK INC., Hsinchu County (TW)

(72) Inventors: Shyh-Jong Chung, Hsinchu County (TW); Ching-Han Tsai, Hsinchu County (TW); Bo-Yi Wang, Hsinchu County (TW)

(73) Assignee: CUBTEK INC., Zhubei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/550,769

(22) Filed: Dec. 14, 2021

(65) Prior Publication Data

US 2022/0109242 A1 Apr. 7, 2022

Related U.S. Application Data

(63) Continuation of application No. 16/996,584, filed on Aug. 18, 2020, now Pat. No. 11,239,565.

(30) Foreign Application Priority Data

May 18, 2020 (TW) ..... 109116349

(51) Int. Cl.

| | |
|---|---|
| ***H01Q 13/20*** | (2006.01) |
| ***H01Q 11/14*** | (2006.01) |
| ***H01Q 13/08*** | (2006.01) |
| ***H01Q 1/52*** | (2006.01) |
| ***H01Q 1/36*** | (2006.01) |

(52) U.S. Cl.

CPC ..... *H01Q 13/206* (2013.01); *H01Q 1/36* (2013.01); *H01Q 1/523* (2013.01); *H01Q 11/14* (2013.01); *H01Q 13/08* (2013.01)

(58) Field of Classification Search

CPC ..... H01Q 1/52; H01Q 1/521; H01Q 1/522; H01Q 1/523; H01Q 1/36; H01Q 13/206; H01Q 11/01

See application file for complete search history.

(56) References Cited

U.S. PATENT DOCUMENTS 4,021,810 A * 5/1977 Urpo ..... H01Q 11/04 343/846
4,063,245 A * 12/1977 James ..... H01Q 13/206 343/846
4,180,817 A 12/1979 Sanford
(Continued)

*Primary Examiner* — Ab Salam Alkassim, Jr.
(74) *Attorney, Agent, or Firm* — Muncy, Geissler, Olds & Lowe, P.C.

(57) ABSTRACT

A multibending antenna structure includes a substrate, a microstrip antenna layer, and at least a decouple unit. The microstrip antenna layer is disposed on one side of the substrate. The microstrip antenna layer includes a plurality of radiation units which are respectively formed in a multibending shape and forming a concave area. The radiation units are sequentially connected to form an antenna array, and a plurality of antenna arrays are disposed in a transversely parallel arrangement, with an interval between each two neighboring antenna arrays. The decouple unit is disposed between the neighboring antenna arrays. When the input end of the radiation unit receives a signal input to emit an electromagnetic wave having a radiation energy, the half-power beam width thereof is increased.

15 Claims, 12 Drawing Sheets

(56) References Cited

U.S. PATENT DOCUMENTS 4,260,988 A * 4/1981 Yanagisawa ..... H01Q 13/206 343/700 MS
4,335,385 A * 6/1982 Hall ..... H01Q 11/04 343/846
4,398,199 A * 8/1983 Makimoto ..... H01Q 11/02 343/700 MS
4,459,593 A * 7/1984 Hall ..... H01Q 11/04 343/731
4,459,594 A * 7/1984 Hall ..... H01Q 21/24 343/731
4,475,107 A * 10/1984 Makimoto ..... H01Q 11/02 343/846
4,801,943 A * 1/1989 Yabu ..... H01Q 21/068 343/823
4,918,457 A * 4/1990 Gibson ..... H01Q 21/068 343/700 MS
4,933,679 A * 6/1990 Khronopulo ..... H01Q 13/206 343/846
5,006,858 A * 4/1991 Shirasaka ..... H01Q 21/08 343/731
5,198,787 A * 3/1993 Sano ..... H01P 5/18 333/204
5,923,295 A * 7/1999 Nakano ..... H01Q 21/0075 343/731
5,936,587 A * 8/1999 Gudilev ..... H01Q 1/38 343/702
6,094,170 A * 7/2000 Peng ..... H01Q 1/38 343/846
6,292,154 B1 * 9/2001 Deguchi ..... H01Q 1/362 343/795
6,424,298 B1 * 7/2002 Nishikawa ..... H01Q 21/065 343/700 MS
6,707,427 B2 * 3/2004 Konishi ..... H01Q 1/362 343/702
6,791,497 B2 * 9/2004 Winebrand ..... H01Q 13/16 343/702
7,142,170 B2 * 11/2006 Saunders ..... H01Q 1/242 343/895
7,408,512 B1 * 8/2008 Rodenbeck ..... H01Q 1/2208 343/700 MS
9,806,419 B2 * 10/2017 Uno ..... H01Q 21/0075
2003/0006940 A1 * 1/2003 Washiro ..... H01Q 1/38 343/895
2005/0110693 A1 * 5/2005 Ryu ..... H01Q 1/243 343/702
2006/0170606 A1 * 8/2006 Yamagajo ..... G06K 19/07749 343/803
2006/0176006 A1 8/2006 Yamagajo et al.
2010/0060457 A1 * 3/2010 Burnside ..... H01Q 13/206 343/810
2010/0238067 A1 * 9/2010 Nakabayashi ..... H01Q 13/206 343/893
2011/0095958 A1 * 4/2011 Mao ..... H01Q 13/206 343/860
2012/0270501 A1 * 10/2012 Borisov ..... G06K 7/0008 455/41.1
2014/0054383 A1 * 2/2014 Andrenko ..... H01Q 1/2216 235/492
2014/0078006 A1 * 3/2014 Park ..... H01Q 9/0485 343/700 MS
2014/0292606 A1 * 10/2014 Hayakawa ..... H01Q 13/206 343/841
2018/0115084 A1 * 4/2018 Tsuchiya ..... H01Q 19/021
2018/0267139 A1 * 9/2018 Park ..... H01Q 1/3233
2019/0131701 A1 * 5/2019 Watanabe ..... H01Q 21/065
2020/0295466 A1 * 9/2020 Foo ..... H01Q 3/443
2020/0313287 A1 * 10/2020 Kona ..... H01Q 21/08
2020/0343648 A1 * 10/2020 Tehran ..... H01Q 21/06
2020/0358195 A1 * 11/2020 Wu ..... H01Q 1/48
2021/0063557 A1 * 3/2021 Yu ..... H01Q 1/3283
2021/0091470 A1 * 3/2021 Ahmadloo ..... H01Q 13/206
2021/0143552 A1 * 5/2021 Shao ..... H01Q 1/2291
2021/0159609 A1 * 5/2021 Lee ..... H01Q 13/206
2021/0210842 A1 * 7/2021 Li ..... G01S 7/03
2021/0242581 A1 * 8/2021 Rossiter ..... H01P 1/2005
2022/0059937 A1 * 2/2022 Kuo ..... H01Q 21/065

* cited by examiner

MULTIBENDING ANTENNA STRUCTURE

BACKGROUND OF THE INVENTION

1. Field of the Invention

The present invention relates to multibending antenna structures, and more particularly, to a multibending antenna structure which improves the half-power beam width thereof.

2. Description of the Related Art

U.S. Pat. No. 4,180,817A discloses a serially connected microstrip antenna array, which is mainly formed on transmission line and radiation members that are serially connected. Such microstrip antenna array, when powered, conducts current signal through the transmission lines, such that the radiation members generates the electromagnetic wave which has radiation energy, so as to sense objects by used of the electromagnetic wave.

However, regarding such antennas, the radiation directions of the radiation members thereof are identical when generating electromagnetic wave, causing the half power beam width (HPBW) to be limited and unable to be increased. Also, the microstrip antenna array is presented in a plurality of amounts, so that radiation disturbance occurs between the neighboring microstrip antenna arrays, wherein the radiation energy strength of the radiation members which is disposed at the front position is obviously greater and weakening the radiation energy strength of the radiations disposed at the rear position. Furthermore, directionality deviation easily occurs, deteriorating the sensing performance of the overall microstrip antenna array.

SUMMARY OF THE INVENTION

For improving the issues above, a multibending antenna structure which improves the half-power beam width thereof is disclosed.

A multibending antenna structure in accordance with an embodiment of the present invention comprises a substrate, a grounding layer, and a microstrip antenna layer. The grounding layer is disposed on one side of the substrate, and the microstrip antenna layer is disposed on another side of the substrate in opposite to the grounding layer. The microstrip antenna layer comprises at least one radiation unit, which is formed in a multibending shape and provided with a concave area. The total length of the radiation unit is equal to 0.8 to 1.2 times the length of the wavelength of a corresponding operation frequency. The radiation unit comprises a signal input end receiving an inputted signal, so as to emit the electromagnetic wave having a radiation energy.

In an embodiment of the present invention, the total length is equal to the whole length of the wavelength.

In an embodiment of the present invention, the radiation unit comprises a head section, a first radiation section, a transition section, a second radiation section, and a tail section, which are sequentially vertical connected to form a multibending shape. The first radiation section, the transition section, and the second radiation section are connected to form the concave area. The total length of the radiation unit is defined as the length from the head section to the tail section.

In an embodiment of the present invention, a plurality of radiation units are sequentially connected to form an antenna array, wherein the tail portion of the preceding radiation unit is connected with the head section of the succeeding radiation unit, such that the connection forms a meander shape.

In an embodiment of the present invention, a plurality of radiation units are included and disposed in a transverse parallel arrangement, with an interval distance between each two neighboring antenna arrays.

In an embodiment of the present invention, the interval distance is equal to a half of the length of the wave length.

In an embodiment of the present invention, a decouple unit is disposed between the neighboring antenna arrays. The decouple unit comprises a conductive portion and a plurality of restrain portion. The restrain portions laterally extend from the conductive portion to form a comb shape. The conductive portion is electrically connected with the grounding layer. Each restrain portion extends to be inserted into the concave area. Therefore, the restrain portion restraints the sensing current of the corresponding radiation unit in the concave area.

In an embodiment of the present invention, the length of the restrain portion is equal to one fourth of the length of the wavelength.

In an embodiment of the present invention, the length of the restrain portion inserted into the concave area is closed to the length of the transition section but not contacting the radiation unit.

In an embodiment of the present invention, a plurality of connection portions are disposed between each conductive portion and the grounding layer. The connection portions pass through the substrate, so as to electrically connect the conductive portion and the grounding layer. The connection portions correspond to the plurality of restrain portions of the corresponding conductive portion.

In an embodiment of the present invention, the length of one of the head section and the tail section is equal to a half of the length of the transition section.

In an embodiment of the present invention, the operation frequency is 77 GHz.

In an embodiment of the present invention, the head section, the first radiation section, the transition section, the second radiation section, and the tail section have a same line width, wherein the ratio between the length of the line width and the wavelength ranges from 1:10 to 1:30.

In an embodiment of the present invention, the concave area has a concave width and a concave depth. The ratio between a length of the transition section and the line width, the concave depth and the line width, or the concave width and the line width, ranges from 6:1 to 10:1.

In an embodiment of the present invention, the ratio is preferably 8:1.

In an embodiment of the present invention, the signal input end inputs an alternating signal. The radiation unit has a terminal end on one end thereof in opposite to the signal input end, wherein the terminal end is free of connection with elements other than the substrate.

In an embodiment of the present invention, the radiation unit and the grounding layer are not electrically connected.

With such configuration, the total length from the head section to the tail section on the microstrip antenna layer corresponds to an operation frequency, and is equal to 0.8 to 1.2 times the length of the wavelength, preferably equals one full length of the wavelength, such that the largest radiation energy is generated on the first radiation section and the second radiation section, whereby the half power beam width if increased by the interference. Thus, the width for sensing objects is improved.

Also, the radiation units of the microstrip antenna layer are sequentially connected one after another to form the antenna array. With the bending structure between the radiation unit sequence, the antenna array achieves an effect of concentrating the radiation energy concentration, thereby maintaining optimal directionality of the microstrip antenna layer.

Further, with the decouple unit between the microstrip antenna layer and the antenna array, the restrain portion in the concave area restraints the sensing current of the corresponding radiation unit, so that the antenna array transmits the averagely distributed current density to the rear radiation units, so as to further increase the half power beam width and achieve a better directionality.

BRIEF DESCRIPTION OF THE DRAWINGS

FIG. 9(*b*) is a schematic view illustrating the current density of the second embodiment provided with the decouple unit disposed between the antenna arrays.

DETAILED DESCRIPTION OF THE INVENTION

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 6, a multibending antenna structure 100, applied in a short-range radar, in accordance with an embodiment of the present invention comprises a substrate 10, a grounding layer 20, and a microstrip antenna layer 30.

The substrate 10 has two sides, with the grounding layer 20 disposed on one side, and the microstrip antenna layer 30 disposed on the other side in opposite to the grounding layer 20. The substrate 10 is formed of a dielectric material, so as to provide the insulation division between the grounding layer 20 and the microstrip antenna layer 30, whereby the conductivity between the grounding layer 20 and the microstrip antenna layer 30 is prevented.

Figure 1:
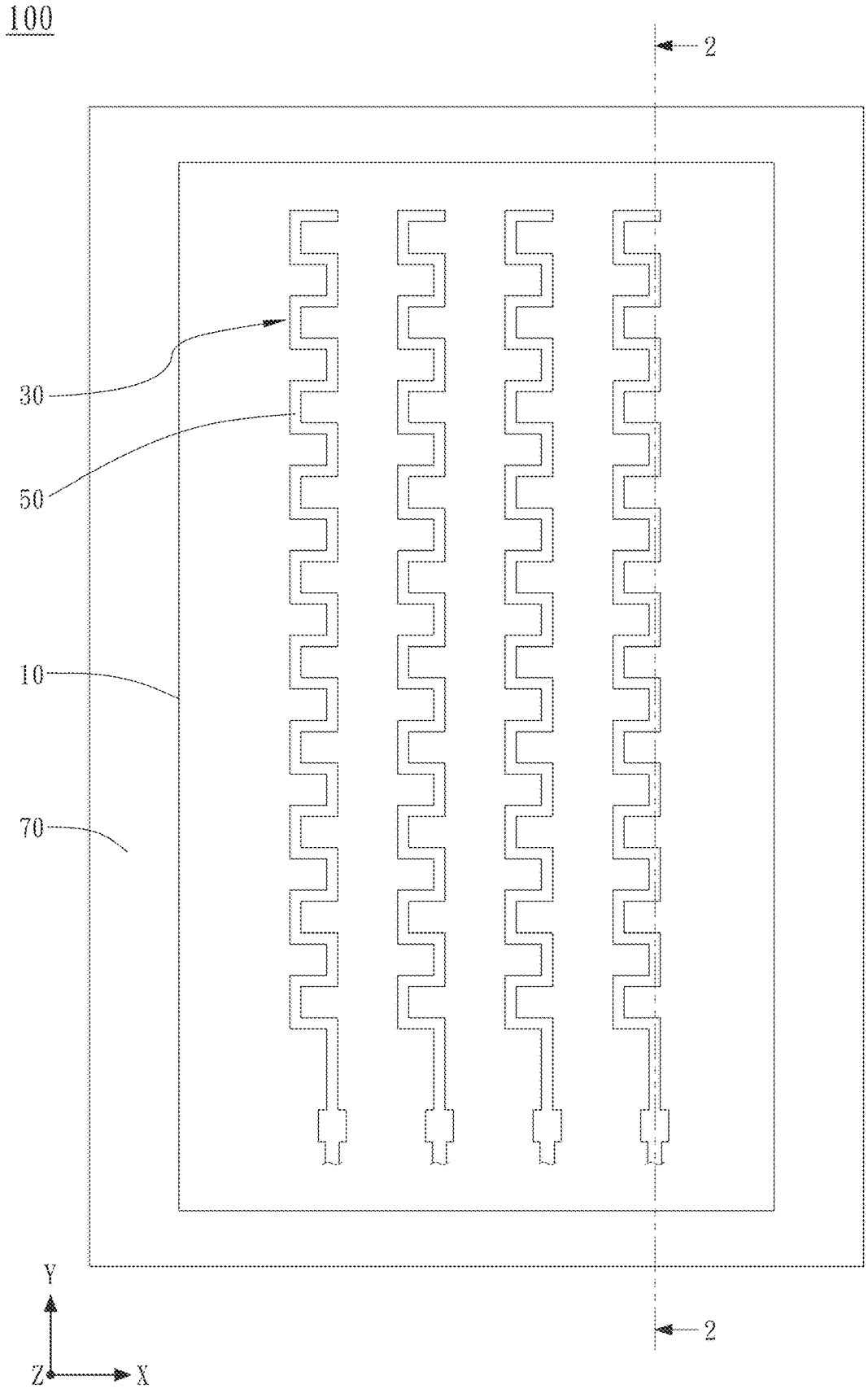
FIG. 1 is a structural plane view of the multibending antenna structure in accordance with an embodiment of the present invention.
Figure 2:
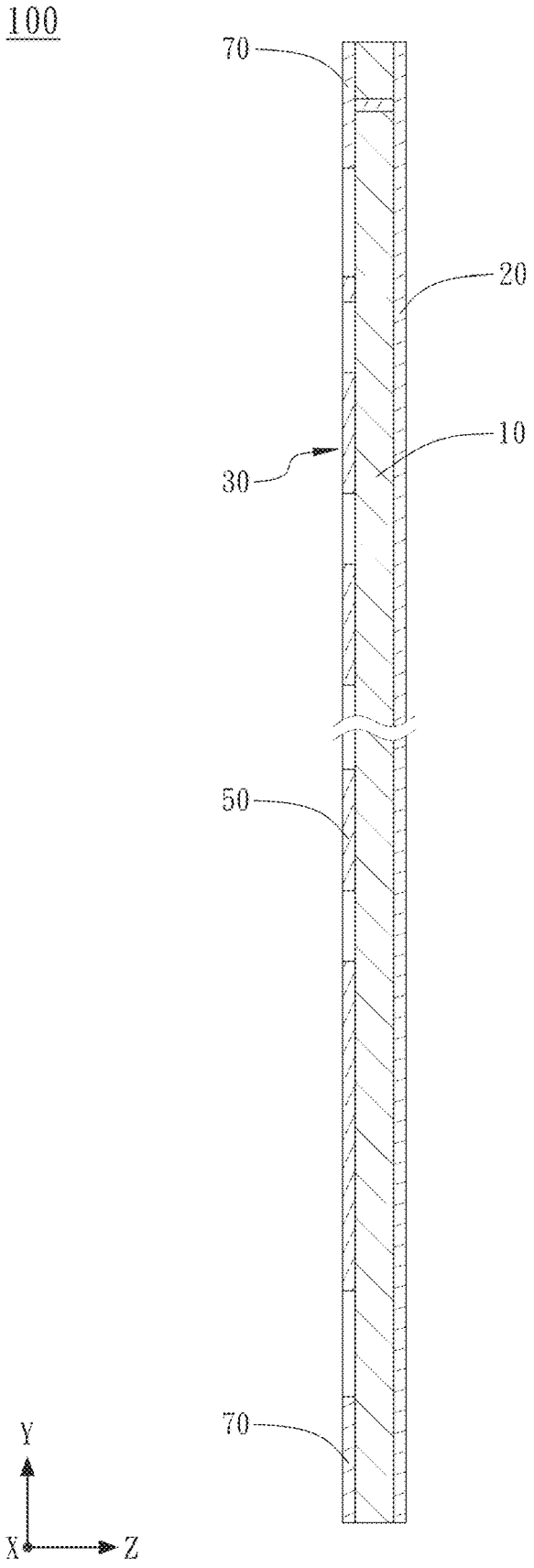
FIG. 2 is a cross-sectional view taken along line 2-2 in FIG. 1.
Figure 3:
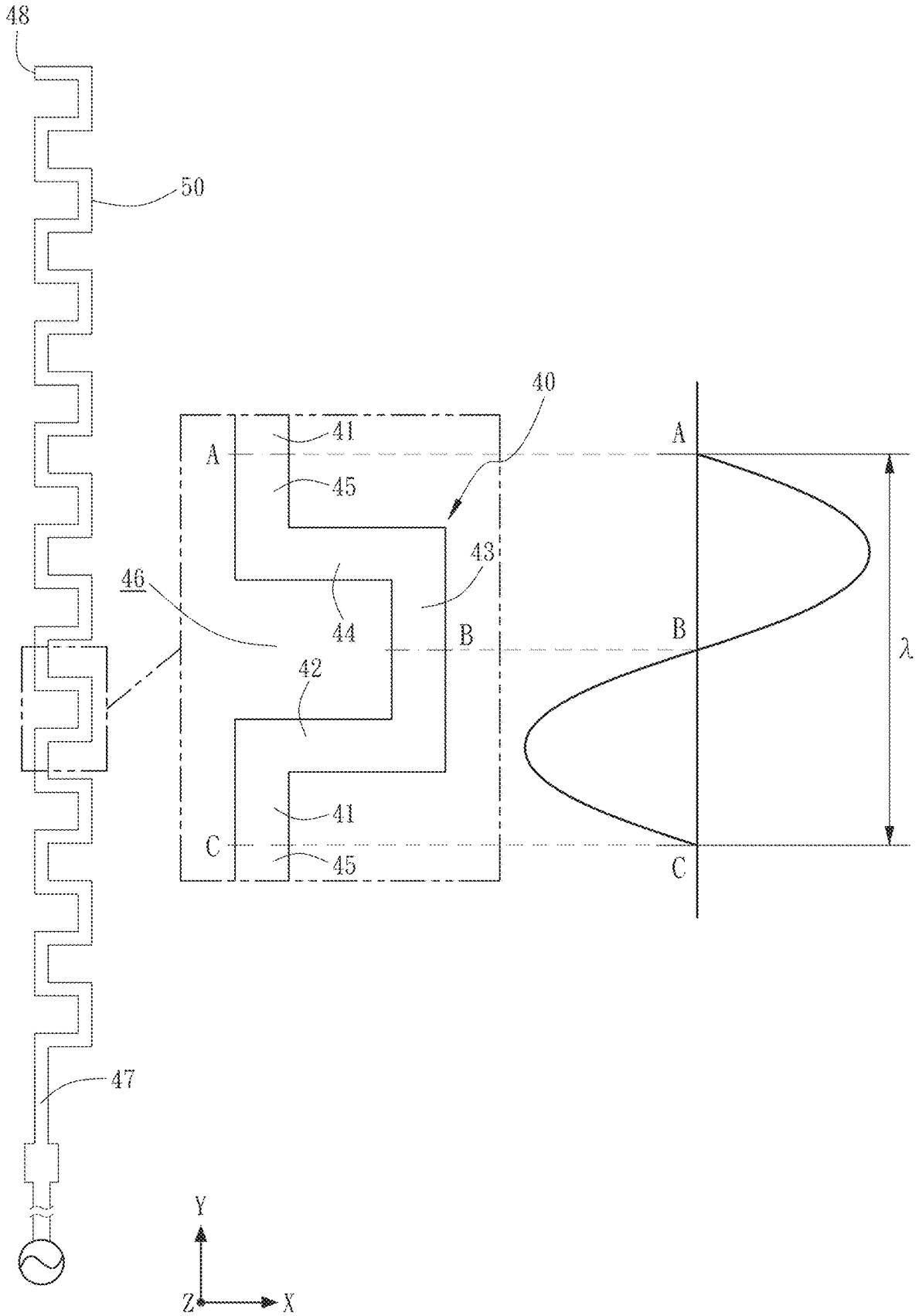
FIG. 3 is a partially enlarged schematic view illustrating the antenna array and the radiation units thereof, wherein the total length of the radiation unit equals to a length of the full wavelength.
Figure 4:
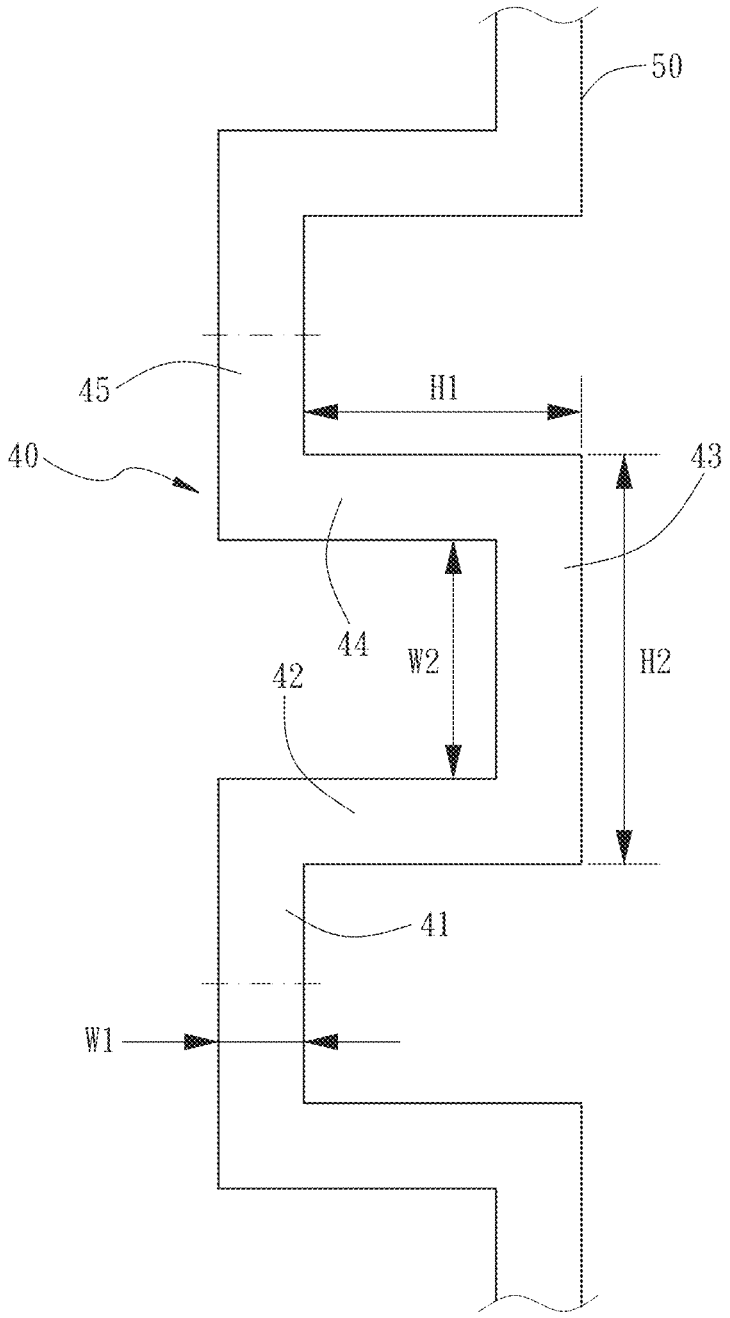
FIG. 4 is another partially enlarged view illustrating the antenna array and the radiation units thereof.

The microstrip antenna layer 30 comprises at least one radiation unit 40, as shown by FIG. 3. The radiation unit 40 is formed in a meander shape comprising a multibending structure. In an embodiment of the present invention, the radiation unit 40 comprises a head section 41, a first radiation section 42, a transition section 43, a second radiation section 44, and a tail section 45 that are sequentially and perpendicularly connected, wherein the first radiation section 42, the transition section 43, and the second radiation section 44 form a concave area 46. The total length of the radiation unit 40 from the head section 41 to the tail section 45 is equal to 0.8 to 1.2 times the length of the wavelength of an operation frequency. The radiation unit 40 further comprises a signal input end 47 for receiving a signal input for generating an electromagnetic wave having a radiation energy. In an embodiment of the present invention, the optimal length equals to the whole length of 1 wavelength. In other words, the total length from the head section 41 to the tail section 45 of the radiation unit 40 is equal to the length of 1 full wavelength $\lambda$.

In an embodiment of the present invention, the microstrip antenna layer 30 comprises four antenna arrays 50, which are disposed in a transversely parallel arrangement with an interval distance between each two neighboring antenna arrays 50. The interval distance is equal to a half of the length of the wavelength. Each antenna array 50 in the embodiment comprises a plurality of radiation units 40 connected in series, wherein the tail section 45 of each radiation unit 40 is connected with the head section 41 of the next radiation unit 40. In an embodiment of the present invention, the operation frequency is, for example but not limited to, 77 GHz. In the embodiment, one antenna array 50 is able to generate 10 wavelengths.

Accordingly, the first radiation unit 40 connected on the antenna array 50 comprises the signal input end 47, and the last radiation unit 40 connected on the antenna array 50 comprises a terminal end 48 (as shown by FIG. 3). Therein, the signal inputted by the signal input end 47 is an alternating signal. The terminal end 48 of the radiation unit 40 is arranged on one end of the antenna array 50 in opposite to the signal input end 47. The terminal end 48 is free of connection with other elements and disposed on the distal end of the antenna array 50 on the substrate 10. Further, the radiation units 40 connected on the antenna array 50, preferably, have no electrical connected with the grounding layer 20.

In an embodiment of the present invention, referring to FIG. 3, which is a partially enlarged view of the radiation unit 40 taken from the antenna array 50, with the operation signal being an alternating signal at a frequency of 77 GHz and presenting a waveform a sine wave, a contact point A, an intermediate point B, and a contact point C exist on the drawing. Therein, the length from contact point A to the contact point C is 4 mm and defined as the total length of the radiation unit 40. Also, the head section 41, the first radiation section 42, the transition section 43, the second radiation section 44, and the tail section 45 have an identical line width W1. The ratio of the line width W1 and the length of the wavelength ranges from 1:10 to 1:30. In the embodiment, the optimal ratio thereof is 1:20. Further, the concave area 46 has a concave width W2 and a concave depth H1, wherein the concave width W2 is approximately 0.57 mm, and the concave depth H1 is approximately 0.66 mm. The transition section 43 has a length H2. A ratio between the transition section length H2 and the line width W1, the concave depth H1 and the line width W1, or the concave width W2 and the line width W1, ranges from 6:1 to 10:1. In the embodiment, the ratio is preferably 8:1.

Figure 5:
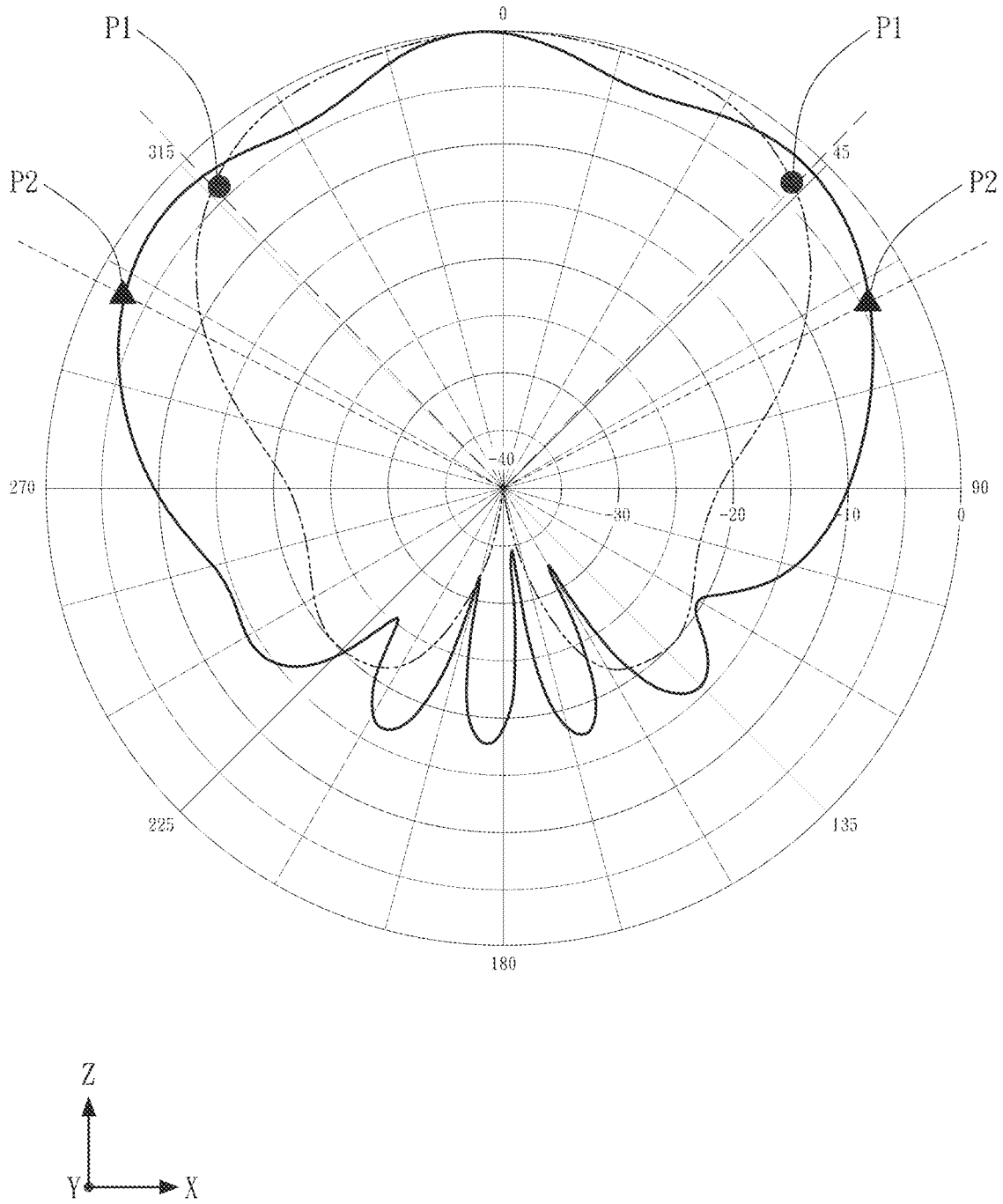
FIG. 5 is a schematic view illustrating the comparison between the beam patterns of the multibending antenna structure and conventional microstrip antenna.

FIG. 5 is a schematic view illustrating the comparison between the beam patterns of the multibending antenna structure 100 and conventional microstrip antenna (radiation pattern of the antenna taken from the reference plane along the axial direction X-Z). The beam pattern of the conventional microstrip antenna is shown by the chain line, and the beam pattern of the multibending antenna structure 100 of the present invention is shown by the solid line. According to the comparison, it can be seen that the half power beam width of the conventional microstrip antenna on the basis of −3 dB has an included angle (angle included by the two points P1) of 84°. Regarding the multibending antenna structure 100, the radiation directions of the electromagnetic wave generated by the radiation units are not identical, so that the half power beam width of the microstrip antenna on the basis of −3 dB has an included angle (angle included by the two points P2) of 128°, which is larger than the angle of the conventional microstrip antenna by 44°, thereby greatly increasing the sensing range for sensing objects. In addition, the radiation units 40 in the antenna array 50 are sequentially connected one after another, so as to achieve the radiation concentration for maintaining an optimal directionality of the microstrip antenna layer 30.

Figure 6:
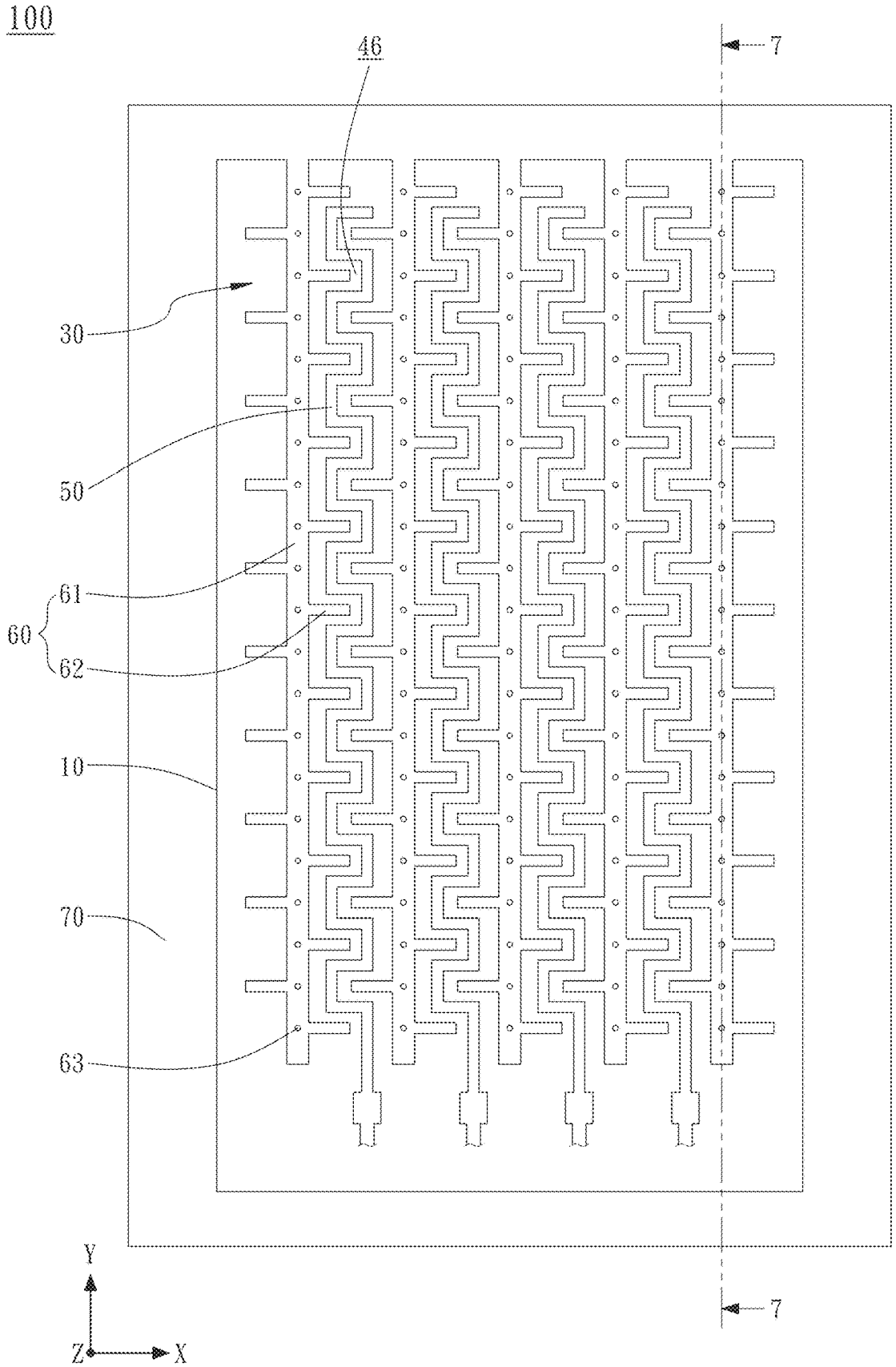
FIG. 6 is a structural plane view of the multibending antenna structure in accordance with a second embodiment of the present invention.
Figure 7:
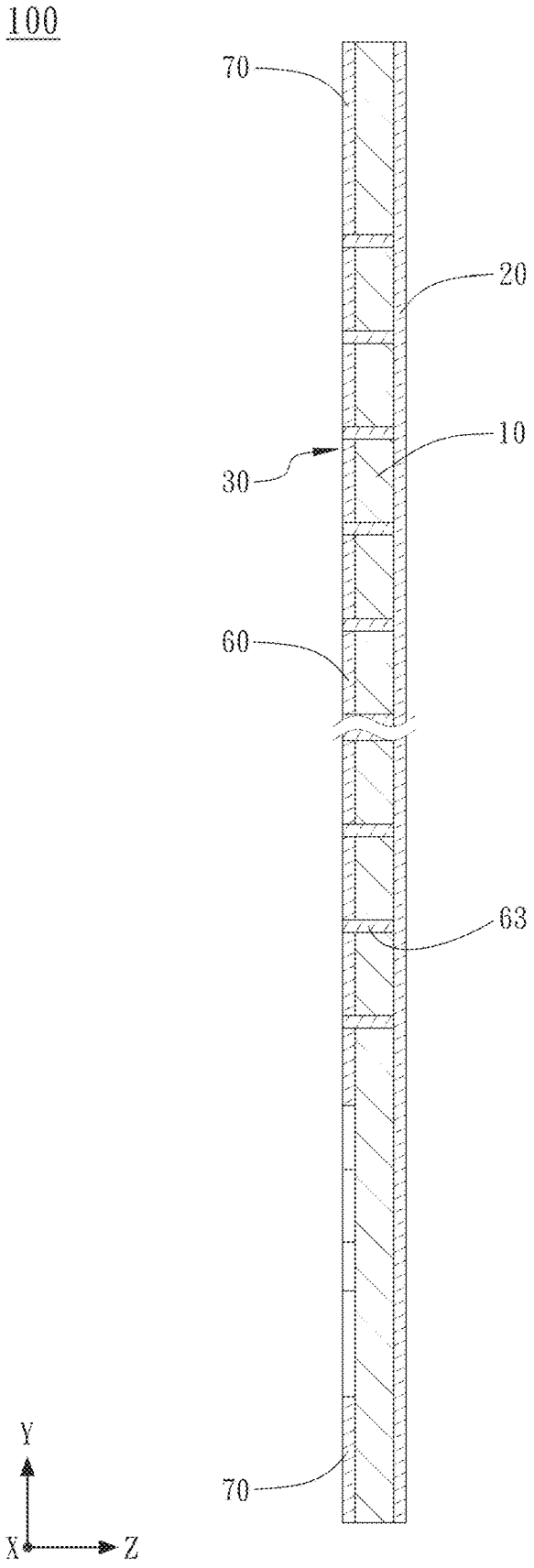
FIG. 7 is a cross-sectional view taken along line 7-7 in FIG. 6.
Figure 8:
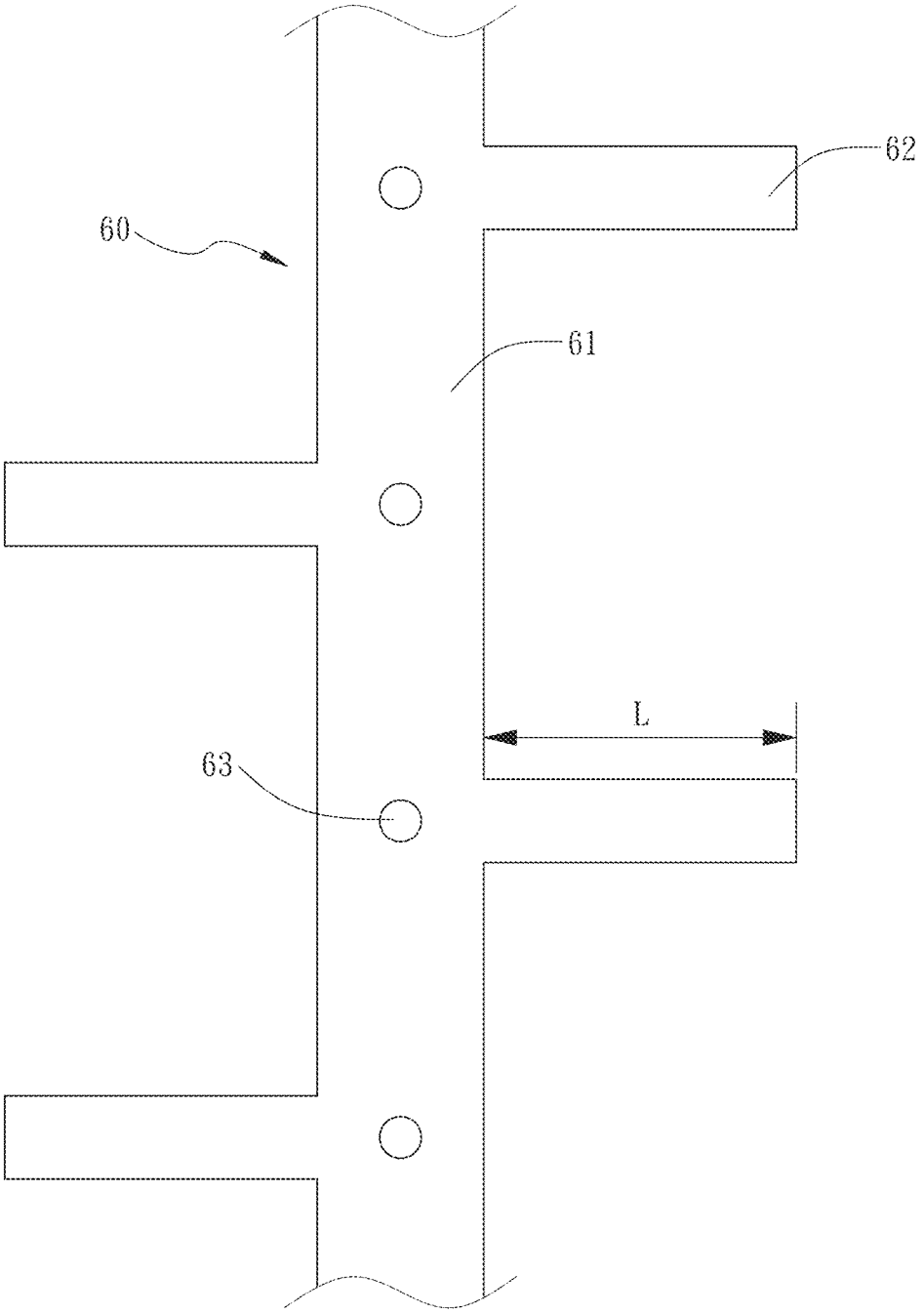
FIG. 8 is a partially enlarged schematic view illustrating the decouple unit in accordance with the second embodiment of the present invention.

Referring to FIG. 6 to FIG. 12, a second embodiment is provided. The major difference with the first embodiment lies in that a decouple unit 60 is included between the neighboring antenna arrays 50. Referring to FIG. 6 and FIG. 8, the decouple unit 60 comprises a conductive portion 61 and a plurality of restrain portions 62. The plurality of restrain portions 62 in the embodiment extend perpendicular to the conductive portion 61 and are presented in a comb shape. In the embodiment, the restrain portions 62 are alternately formed on both sides of the conductive portion 61. The length L of each restrain portion 62 is equal to approximately one fourth of the length of the wavelength. The length of the restrain portion 62 inserted into the concave area 46 is closes to the length of the transition section 43, but the restrain portion 62 does not contact the radiation unit 40. The restrain portion 62 is preferably inserted into the concave area 46 to be closed to the position having a higher strength of the radiation energy.

In an embodiment of the present invention, a plurality of connection portions 63 are disposed between each conductive portion 61 and the grounding layer 20. The plurality of connection portions 63 pass through the substrate 10, so as to electrically connect the conductive portion 61 and the grounding layer 20. Also, the connection portions 63 are disposed corresponding to the plurality of restrain portions 62 of the corresponding conductive portion 61. In the embodiment, each restrain portion 62 on two sides of the conductive portion 61 has a connection portion 63, respectively. The connection portion 63 is formed on copper material for providing a conductor in the via, such that the conductive portion 61 is electrically connected with the grounding layer 20 to achieve a ground connection through the portion on where the restrain portion 62 is disposed. Also, a side layer 70 is disposed on one side of the substrate 10 having the microstrip antenna layer 30, wherein the side layer 70 is electrically connected with the grounding layer 20, and each conductive portion 61 has one end thereof connected with the side layer 70 to achieve a ground connection. Further referring to FIG. 6, each restrain portion 62 of the decouple unit 60 is inserted into the concave area 46 of each radiation unit 40, whereby the restrain portion 62 restraints the sensing current of the corresponding radiation unit 40 in the concave area 46.

Figure 9B:
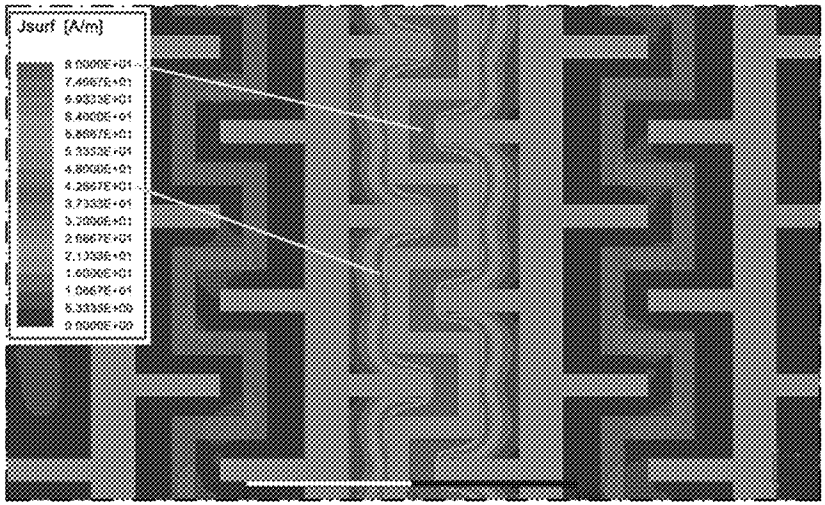
FIG. 9(*a*) is a schematic view illustrating the current density of the second embodiment without the decouple unit disposed between the antenna arrays.
Figure 9A:
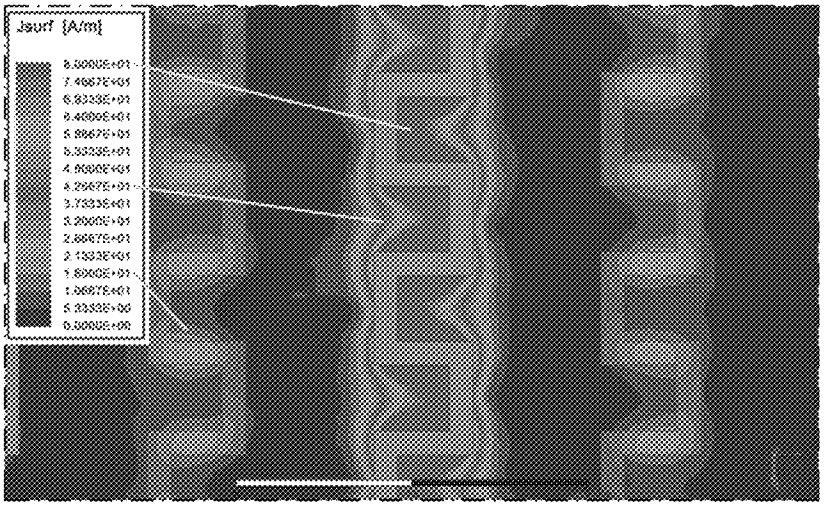

FIG. 9(*a*) and FIG. 9(*b*) are schematic views illustrating the current density of the antenna arrays 50 provided with and without the decouple unit 60 disposed between the antenna arrays. In FIG. 9(*a*), as shown by the indication lines therein, the highest current density (the highest index approximately at 8.0000E+01) is detected in the concave area 46. The current density detected around the antenna array 50 is weakened (the index approximately from 2.1333 E+01 to 6.4000E+01). Due to the decoupling effect with the neighboring antenna array 50, interference of the radiation energy (the index approximately from 5.3333 E+00 to 1.6000E+01) is generated on the first and second radiation sections. In FIG. 9(*b*), as shown by the indication lines therein, the highest current density (the highest index approximately at 8.0000E+01) is still detected in the concave area 46, but is obviously suppressed. The current density detected around the antenna array 50 is weakened (the index approximately from 2.1333 E+01 to 6.4000E+01). Due to the decouple unit 60, the interference of radiation energy of the antenna array 50 caused by the decoupling effect is lowered, even eliminated. Referring to FIG. 9(*a*), without the decouple unit 60, the current density between each first radiation section 42 and second radiation section 44 is obviously higher and has an energy dissipation condition, thereby causing a mutual coupling phenomenon. As a result, the current transmitted to the rear radiation unit 40 in the antenna array 50 undergoes an obvious loss, which causes an energy loss affecting the energy transmission thereof. Further, the mutual coupling phenomenon causes an interference of the radiation energy between the neighboring antenna arrays 50. In contrast, with the decouple unit 60, which serves like a band-pass filter, a decoupling effect is generated, as shown by FIG. 9(*b*), and the current density of the antenna array 50 is restrained by the restrain portion 62. As a result, the energy loss is lowered, allowing the energy to be transmitted further to reach the last radiation unit 40. Also, due to the decouple unit 60 between the neighboring antenna arrays 50, the radiation between the antenna arrays 50 caused by conductivity of current is blocked, so as to prevent the interference generated by radiation energy between the antenna arrays 50 from happening.

Figure 10:
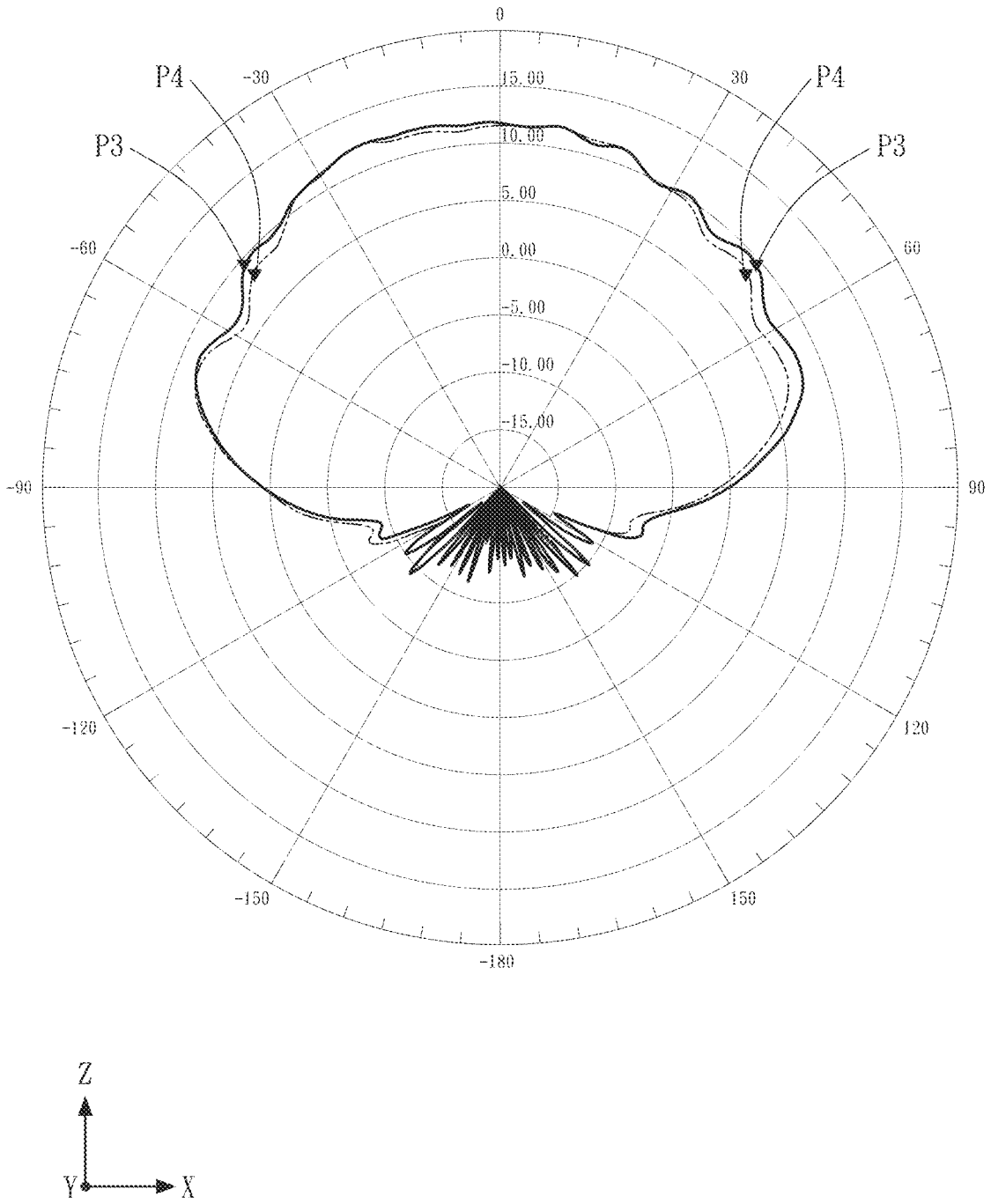
FIG. 10 is a schematic view illustrating the comparison between the beam patterns of the antenna arrays provided with and without the decouple unit.

FIG. 10 shows the radiation pattern of the antenna taken from the reference plane along the axial direction X-Z, in which the beam pattern of the multibending antenna structure 100 provided with the decouple unit 60 between the antenna arrays 50 is illustrated (solid line). As aforementioned, the decouple unit 60 lowers the energy loss of the current density for facilitating the longer distance transmission. Thus, compared with the beam pattern of the multibending antenna structure 100 without the decouple unit 60, the multibending antenna structure 100 having the decouple unit 60 is expanded by approximately 1 dB (point P3 is on outer side than point P4).

Figure 11:
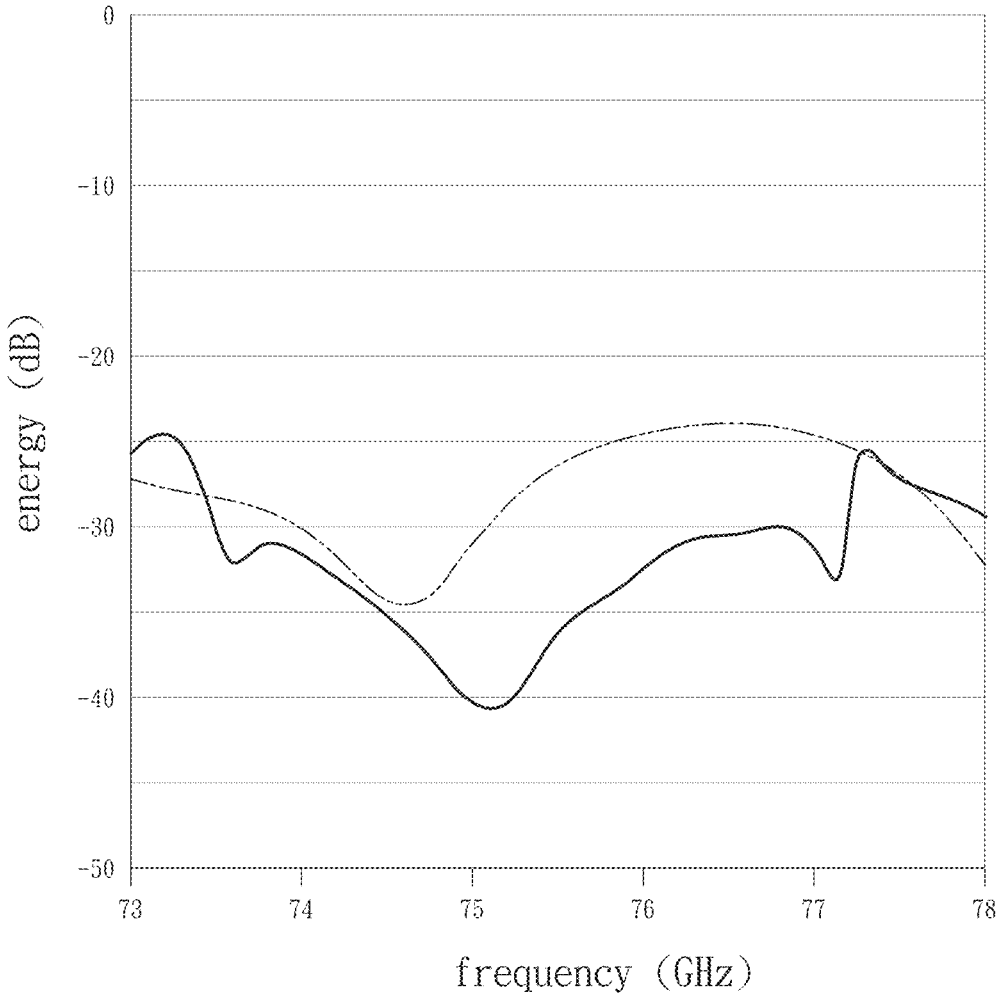
FIG. 11 is a schematic view illustrating the comparison between the isolation curves of the antenna arrays provided with and without the decouple unit.

Referring to FIG. 11, taking the isolation as a comparison standard, at the frequency of 76.5 GHz, the optimal isolation of the multibending antenna structure 100 having the decouple unit 60 (solid line) is approximately −30.46 dB. Differently, the optimal isolation of the multibending antenna structure 100 without the decouple unit 60 (chain line) is approximately −23.88 dB, which is improved by 6.58 dB as compared to the former. Notably, with the improvement of the isolation between the antenna arrays 50, the interval between the antenna arrays 50 does not have to be increased on the substrate 10. Therefore, the density of antenna arrays 50 in the same unit square is allowed to be increased.

Figure 12:
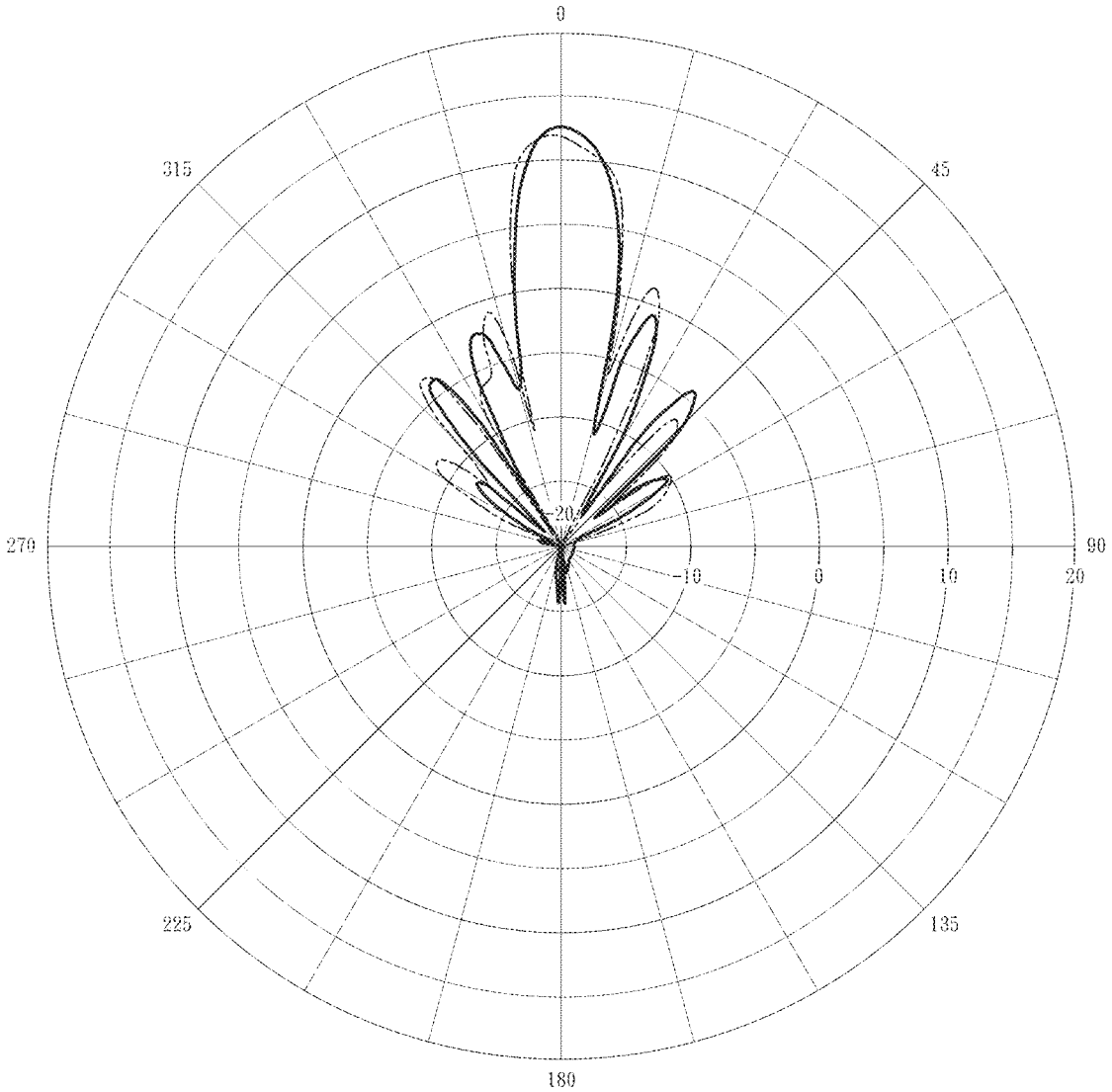
FIG. 12 is a schematic view illustrating the comparison between the side lobe levels of the antenna arrays provided with and without the decouple unit.
Figure 12:
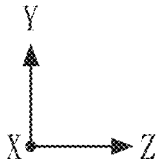

FIG. 12 shows the radiation pattern of the antenna taken from the reference plane along the axial direction Y-Z. It can be seen that the side lobe level (SLL) of the multibending antenna structure 100 having the decouple unit 60 (solid line) is obviously decreased as compared to the multibending antenna structure 100 without the decouple unit 60 (chain line). It means that when the decouple unit 60 is presented between the antenna arrays 50, the energy dissipation effect upon the interaction of side lobes and the effect of the main lobe is lowered, so that the radiation energy of the antenna arrays 50 is prevented from being transmitted to unnecessary positions. Therefore, performance of the peak gain and the side lobe level of the multibending antenna structure 100 having the decouple unit 60 is optimal than that of the multibending antenna structure 100 without the decouple unit 60, achieving a better directionality.

Notably, in the second embodiment, although the decouple unit 60 is applied in the radiation unit 40 having the head section 41, the first radiation section 42, the transition section 43, the second radiation section 44, and the tail section 45 that are sequentially connected in the antenna array 50, the decouple unit 60 is allowed to be applied in different forms of antenna array, such as other meander antenna arrays formed in a lightning shape, wave shape, square shape, or a series combination (not shown).

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multibending antenna structure, comprising:

a substrate;

a microstrip antenna layer disposed on one side of the substrate, the microstrip antenna layer comprising a plurality of radiation units which are respectively formed in a multibending shape and forming a concave area, the radiation units being sequentially connected to form an antenna array, wherein a plurality of antenna arrays are disposed in transversely parallel arrangement, with an interval distance between each two neighboring antenna arrays; and at least a decouple unit disposed between the neighboring antenna arrays, the decouple unit comprising a conductive portion and a plurality of restrain portions, the restrain portions laterally extending from the conductive portion, each restrain portion extending to be inserted into the corresponding concave area, such that the restrain portion restrains a sensing current of the corresponding radiation unit in the concave area.

2. The antenna structure of claim 1, wherein a total length of the radiation unit is equal to 0.8 to 1.2 time a length of a wavelength of an operation frequency; the radiation unit comprises a signal input end for receiving a signal input in order to emit an electromagnetic wave having a radiation energy.

3. The antenna structure of claim 2, wherein each radiation unit comprises a head section, a first radiation section, a transition section, a second radiation section, and a tail section that are perpendicularly connected in a multibending shape; the first radiation section, the transition section, and the second radiation section form the concave area; the total length of the radiation unit is defined as a length from the head section to the tail section.

4. The antenna structure of claim 1, wherein a grounding layer is disposed on one side of the substrate in opposite to the microstrip antenna layer, and the conductive portion is electrically connected with the grounding layer.

5. The antenna structure of claim 2, wherein the interval distance is equal to a half of the whole length of the wavelength.

6. The antenna structure of claim 1, wherein the restrain portions laterally extend from the conductive portion to form a comb shape.

7. The antenna structure of claim 2, wherein a length of each restrain portion is equal to one fourth of the whole length of the wavelength.

8. The antenna structure of claim 3, wherein a length of the restrain portion inserted into the concave portion approximates to a length of the transition section but does not contact the radiation unit.

9. The antenna structure of claim 4, wherein a plurality of connection portions are disposed between each conductive portion and the grounding layer corresponding to the plurality of restrain portions for electrically connecting the conductive portion and the grounding layer.

10. The antenna structure of claim 3, wherein a length of the head section or the tail section is equal to a half of a length of the transition section.

11. The antenna structure of claim 3, wherein the head section, the first radiation section, the transition section, the second radiation section, and the tail section have an identical line width; a ratio of the line width and the length of the wavelength ranges from 1:10 to 1:30.

12. The antenna structure of claim 3, wherein the head section, the first radiation section, the transition section, the second radiation section, and the tail section have an identical line width; the concave area has a concave width and a concave depth; a ratio between a length of the transition section and the line width, the concave depth and the line width, or the concave width and the line width, ranges from 6:1 to 10:1.

13. The antenna structure of claim 12, wherein the ratio is 8:1.

14. The antenna structure of claim 2, wherein the signal input end inputs an alternating signal; the radiation unit has a terminal end on one end thereof in opposite to the signal input end; the terminal end is free of connection with elements other than the substrate.

15. The antenna structure of claim 4, wherein the radiation unit is not electrically connected with the grounding layer.

* * * * *